US005518787A

United States Patent [19]

Konkol

[11] Patent Number: 5,518,787

[45] Date of Patent: May 21, 1996

[54] CONSTRUCTION FOR A LAMINATED CARD OR LABEL

[75] Inventor: Patrick A. Konkol, Cincinnati, Ohio

[73] Assignee: The Standard Register Company, Dayton, Ohio

[21] Appl. No.: 851,319

[22] Filed: Mar. 16, 1992

[51] Int. Cl.[6] ..... B65D 65/28

[52] U.S. Cl. ..... 428/43; 428/40.1; 428/202; 428/354; 428/195; 428/914; 428/916

[58] Field of Search ..... 156/250, 257, 156/268, 247, 243, 244.16, 248; 428/40, 41, 42, 43, 202, 352, 354, 914, 916, 195

[56] References Cited

U.S. PATENT DOCUMENTS

| | | | |
|---|---|---|---|
| 3,068,140 | 12/1962 | Biddle | 156/277 |
| 3,420,364 | 1/1969 | Kennedy, Jr. | 156/230 |
| 3,524,782 | 8/1970 | Buske | 156/248 |
| 3,554,835 | 1/1971 | Morgan | 156/249 |
| 4,070,774 | 1/1978 | Staats et al. . | |
| 4,479,838 | 10/1984 | Dunsirn et al. | 156/247 |
| 4,545,838 | 10/1985 | Minkus et al. . | |
| 4,632,428 | 12/1986 | Brown . | |
| 4,645,241 | 2/1987 | Sfikas . | |
| 4,724,166 | 2/1988 | de Bruin | 427/382 |
| 4,837,088 | 6/1989 | Freedman | 156/238 |
| 4,854,610 | 8/1989 | Kwiatek | 156/234 |
| 4,863,772 | 9/1989 | Cross | 156/242 |
| 4,986,865 | 1/1991 | Schmidt . | |
| 5,019,436 | 5/1991 | Schramer et al. | 156/244.11 |

*Primary Examiner*—Patrick J. Ryan
*Assistant Examiner*—Merrick Dixon
*Attorney, Agent, or Firm*—Killworth, Gottman, Hagan & Schaeff

[57] ABSTRACT

A construction for a laminated card or label is provided including a transparent film having a pressure sensitive adhesive on one surface thereof and liner stock having first and second major surfaces. The first surface has a release coating adhered to the pressure sensitive adhesive on the film. Variable information may be printed on the second surface of the liner stock within the die cut area, and the die cut card removed from the transparent film and replaced printed side down onto the adhesive surface of the film, thereby laminating the card to the film. The card is then peeled away from remainder of the construction at the die cut around the film and folded with the indicia facing outward to laminate the sides the card together. The printed surfaces of the card are direct contact with the adhesive, thus preventing tampering of the card.

18 Claims, 3 Drawing Sheets

CONSTRUCTION FOR A LAMINATED CARD OR LABEL

BACKGROUND OF THE INVENTION

This invention relates to a construction for producing a laminated card or label, and more particularly to a construction which allows information to be printed by a variety of printing devices on both the front and back sides of the card or label, and provides laminated protection to both sides of the card or label.

Lamination is a well known process for preserving indicia bearing materials such as identification cards, labels, and the like. In the manufacture of such devices, the labels or cards are typically affixed to forms and information is typed or printed onto them. The card or label to be laminated is then separated from the form and placed between two transparent plastic layers which are then secured together around the periphery of the card either by heat sealing or by an adhesive.

However, problems may be encountered in typing or printing data on the cards because of the additional thickness which they present affixed to the form. If the cards are printed on an automated printing device, feeding problems may also occur due to the thickness of the cards or the uneven caliper of the form.

Another limitation of lamination processes is that the construction of the card or label does not permit a printing device to simultaneously print both sides of the card; consequently, the card must be printed on one side, turned over, and then printed on the other side. Furthermore, the lamination of the cards requires a separate step using transparent plastic film from another source, resulting in a time consuming and expensive process.

In addition, depending upon the method of lamination used, the plastic covering may be easily removed from the card, subjecting the card to tampering. For example, if only a peripheral adhesive is used to laminate the two transparent plastic film layers, it may be possible to remove the card without evidencing any tampering.

Several attempts have been made to produce an improved construction for labels or identification cards. Biddle, U.S. Pat. No. 3,068,140, teaches an identification card construction in which the front and back sides of a card are positioned side by side on a base sheet such that variable information may be printed or typed on the card. The base sheet containing the card is then cut, folded, and covered with individual sheets of transparent plastic material which are fused together under heat and pressure to laminate the card. However, this construction requires a separate lamination step.

Schmidt, U.S. Pat. No. 4,986,868, teaches a method for making an identification card in which a transparent web having a pressure sensitive adhesive on its underside is adhered to a form having a ply of base stock on one half and a release liner on the other half. The half containing the base stock is printed with indicia such that when the liner is removed, the pressure sensitive adhesive is exposed and the card folded over to produce a laminated card. However, Schmidt requires separate printing steps for printing the front and back sides of the card.

Sfikas, U.S. Pat. No. 4,645,241, teaches a laminating envelope for an identification card in which a thermoplastic sheet comprising three panels is arranged so that a pocket is formed for holding the card and a release strip secured to the outer portion of the third panel is removed to expose adhesive for securing the first panel to the third panel upon folding. However, the card is designed so that it may be removed from the pocket without damage, which would render it subject to tampering.

Consequently, while these card or label constructions may be useful, they are disadvantageous in that they require separate printing or lamination steps, or do not offer any means of protection against tampering for the laminated card. Accordingly, the need still exists in the art for an improved construction for producing a laminated card or label which eliminates the need for separate printing and laminating steps, and prevents tampering of the card.

SUMMARY OF THE INVENTION

The present invention meets that need by providing a construction for a laminated card or label which allows information to be printed on both sides of the card or label in a single pass and allows the card or label to be laminated on both sides for protection using a transparent film which forms a part of the card or label construction.

The construction preferably comprises a transparent film which is die cut in the form of a card or label and has a pressure sensitive adhesive on one of its surfaces. Preferably, the transparent film comprises polyester and the pressure sensitive adhesive comprises a permanent acrylic adhesive. The construction also comprises liner stock having first and second major surfaces. Preferably, the liner stock comprises a silicone-coated machine finish liner. The first surface of the liner stock includes a release coating and is adhered to the pressure sensitive adhesive on the surface of the transparent film. The second surface of the liner stock is adapted to receive printed indicia. Preferably, the liner stock is die cut in the form of a card or label such that the front and back sides of the card or label are positioned adjacent each other in a side-by-side relationship.

Preferably, the front and back sides of the card or label are separated by a score or perforation line to assist in folding the card. In addition, the die cut area of the transparent film preferably extends beyond the die cut area of the liner stock so that when the card is laminated, the adhesive permanently seals the periphery of the card.

The present invention also provides a method for making a laminated card or label which first comprises the step of providing a construction of the transparent film which is die cut in the form of a card or label and has a pressure sensitive adhesive on one surface thereof, and liner stock which is die cut in the form of a card or label having first and second major surfaces where the first surface includes a release coating and is adhered to the pressure sensitive adhesive on the surface of the transparent film. Indicia is then printed onto the second surface of the liner stock within the area bounded by the die cut. Printing may occur in two stages, with non-variable information being preprinted onto the liner stock and variable information printed, typed, or handwritten onto the liner stock shortly before lamination. The die cut portion of the liner stock which forms the card or label is then removed from the transparent film and replaced printed side down onto the adhesive surface of the transparent film, thus laminating the surface of the card or label to the film.

The construction is then turned over, and the laminated card or label is peeled away from the remainder of the construction at the die cut around the transparent film, and is folded with the printed indicia facing outward so that the sides of the card or label are laminated together. Preferably, the die cut area of the transparent film is greater than the die cut area of the card or label so that the folding step laminates the adhesive edges of the film to each other. Where the liner stock includes a score or perforation line, the folding step also includes folding along the score or perforation line.

In an alternative embodiment of the invention, the card may be folded after it is first removed from the construction and replaced onto only half of the die cut area containing the pressure sensitive adhesive. When the construction is turned over and the transparent film is removed, the card is then pulled away with the film and the film folded over to complete the lamination.

This, and other objects and advantages of the present invention will become apparent from the following detailed description, the accompanying drawings, and the appended claims.

DETAILED DESCRIPTION OF THE PREFERRED EMBODIMENT

Figure 1:
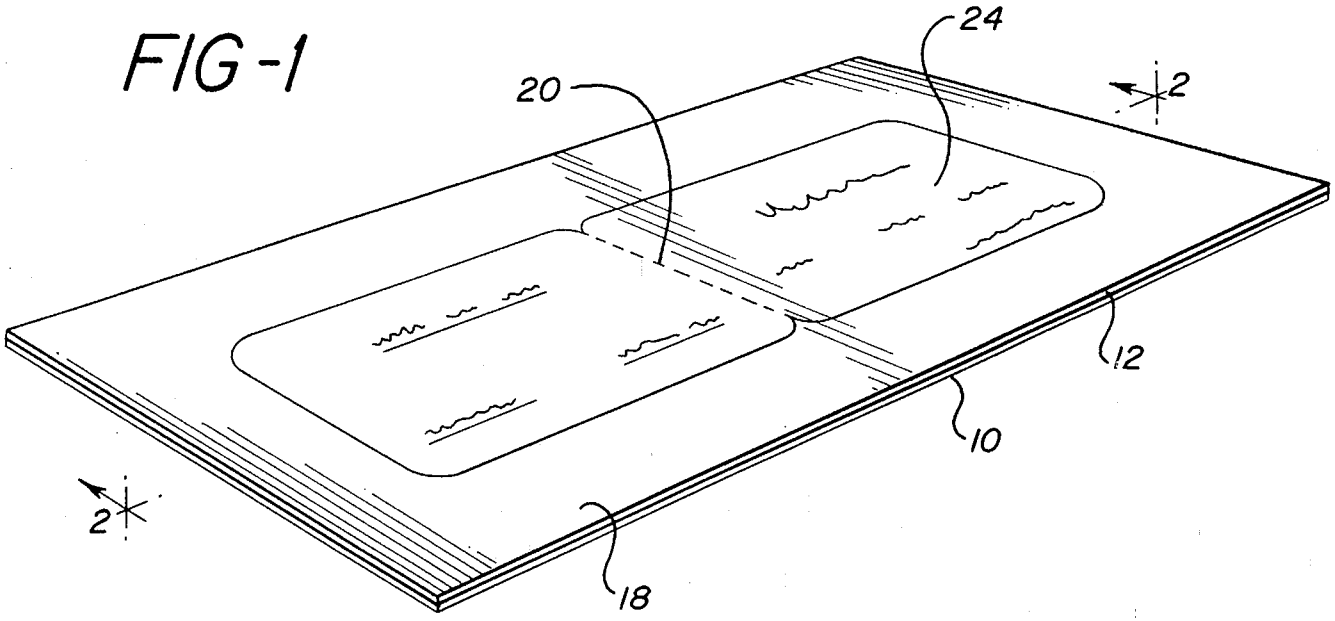
FIG. 1 is a perspective view of a construction for producing a laminated card or label in accordance with the present invention.
Figure 2:
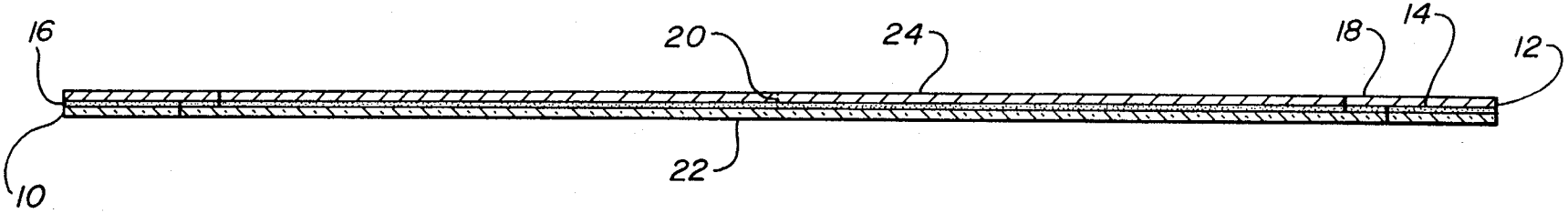
FIG. 2 is a sectional view of the construction shown along line 2—2 in FIG. 1.

The construction of the present invention for a laminated card or label is illustrated in FIGS. 1 and 2 and comprises a transparent film 10 which is die cut in the form of a card and has a pressure sensitive adhesive 16 on one of its surfaces. The transparent film preferaby comprises polyester, but may also comprise (polystyrene, polypropylene, polycarbonate, cellophane, or any other suitable transparent or translucent material). The pressure sensitive adhesive preferably comprises a permanent acrylic adhesive, but may comprise any transparent or translucent pressure sensitive adhesive. The construction also includes liner stock 12 which is comprised of a silicone-coated machine finish liner having first and second major surfaces. The first surface 14 of the liner stock includes a silicone-based release coating which is adhered to the pressure sensitive adhesive 16 on the surface of the transparent film. The second surface 18 of the liner stock is adapted to receive printed indicia and is die cut in the form of a card as shown in die cut area 24 such that the front and back sides of the card are positioned adjacent each other in a side-by-side relationship. The front and back sides of the card may be separated by a score or perforation line 20 to assist in folding the card.

The cross section of the construction illustrated in FIG. 2 shows die cut area 22 of the transparent film extending beyond the die cut area 24 of the liner stock. This construction is preferred so that when the card is laminated, the adhesive 16 seals the periphery of the card.

The laminated card construction may be produced as a continuous web product or as a cut sheet or roll product. Nonvariable indicia may be preprinted onto the liner stock in a single pass through a conventional label press. For example, the card may be designed to be an identification card for a group health insurance plan The nonvariable legends such as "Name" "Address" "Group No" and "Policy No" may be preprinted onto the liner stock. Machine readable information such as bar codes may also be printed on the liner stock. Multiple print colors may also be utilized.

After preprinted information is added to the web, the web is advanced through two die cut stations. At the first station, the web is die cut through the liner stock, but not through the transparent film. At the second station, cuts are made through the transparent film which are parallel to the liner stock cuts, circumscribing the liner stock cuts at such a distance from the liner stock cuts so that a sealing edge is provided when the card is eventually folded over by the user. The transparent film is preferably cut so that it is about 1/16 to 1/4 inch larger on all sides than the liner stock. Thus, a continuous web is produced having a series of repeating two-ply cards spaced equally apart from each other on the web. If desired, additional die cuts may be made in the transparent film so that a continuous selvage of the two-ply material may be removed from the web.

After the web has been die cut, it may be advanced to a perforating station and a folding station, or alternatively, to a sheeting station. The continuous web product is then ready for shipment to a customer where variable information may be added by the end user. Because of the uniform thickness of the construction, it may be printed with variable information by a number of different automated printing devices including impact printers, laser printers, or thermal transfer printers. As illustrated in FIG. 1, variable indicia may be printed onto the second surface 18 of the liner stock within the area 24 bounded by the die cut.

Figure 3:
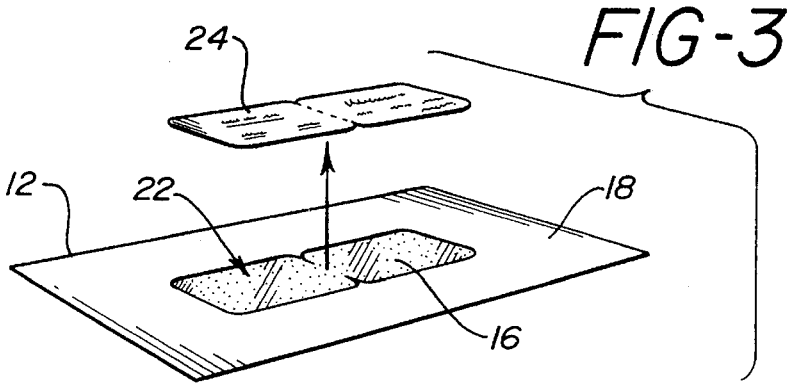
FIG. 3 is a perspective view showing the card after printing has occurred and after removal from the transparent film.
Figure 4:
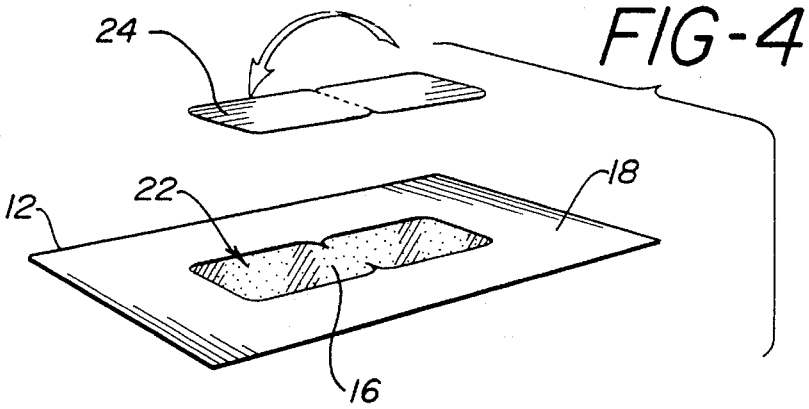
FIGS. 4 and 5 show perspective views of the card being turned over and replaced face down onto the pressure sensitive adhesive side of the transparent film.
Figure 5:
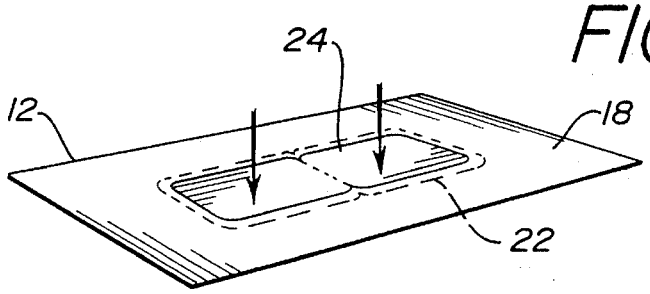

As illustrated in FIGS. 3 and 4, once indicia have been printed onto surface 18, and the card is sent to the individual recipient, the die cut portion 24 of the liner stock 12 which forms the card is then removed by the recipient from the transparent film (by peeling away the release-coated surface) and replaced printed side down onto the adhesive surface 16 of the transparent film as illustrated in FIG. 5, laminating the card to the film. The cut out edges of the remaining liner stock act as a template to guide proper repositioning of the card.

Figure 6:
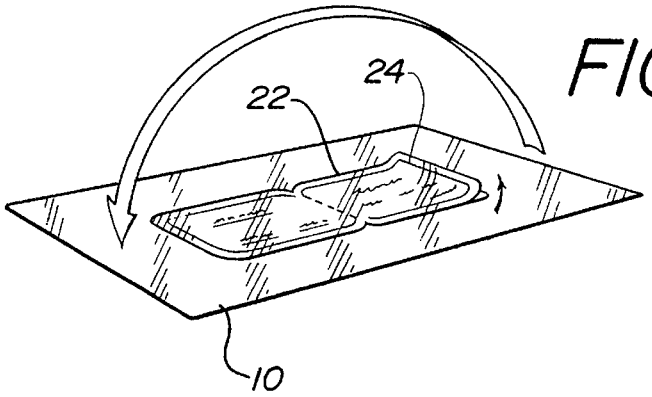
FIG. 6 is a perspective view showing the card being peeled back along with the die cut portion of the transparent film.
Figure 7:
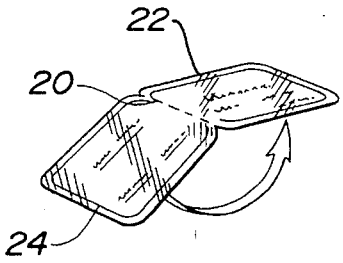
FIG. 7 is a perspective view illustrating the folding of the film and card.

As illustrated in FIGS. 6 and 7, the construction is then turned over so that the transparent film 10 is facing upward, and the laminated card is then peeled away from the remainder of the construction at the die cut around the film, and is folded with the indicia facing outward so that the sides of the card are laminated together.

In an alternative embodiment of the invention, the card may be folded when it is first removed from the construction and replaced onto only half of the die cut area containing pressure sensitive adhesive 16. When the construction is turned over and the transparent film is removed, the card is then pulled away with the film and the film is folded over to complete the lamination.

Figure 8:
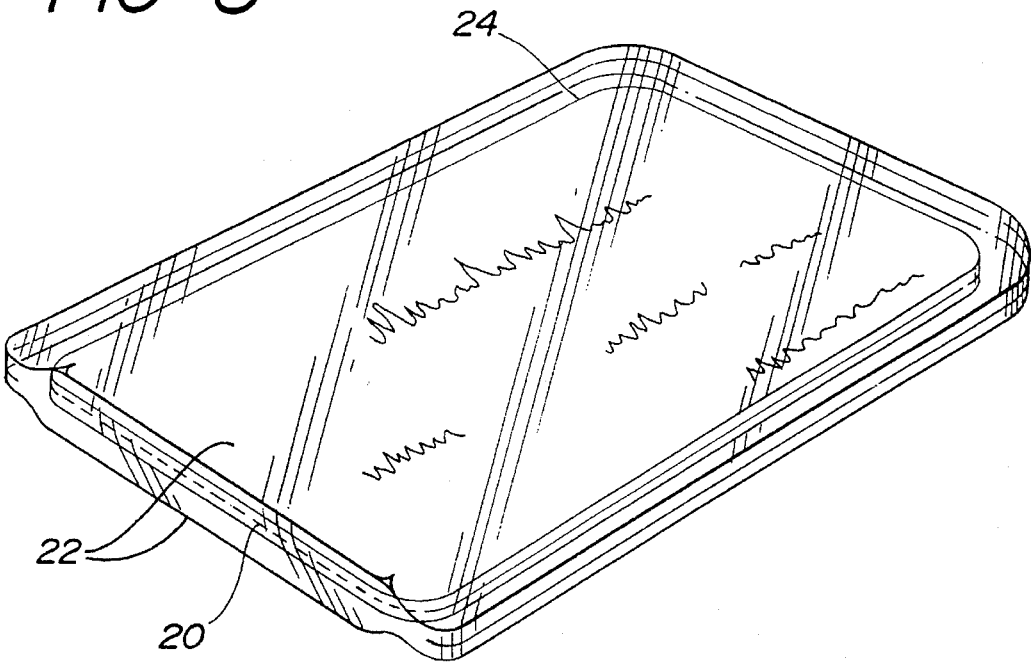
FIG. 8 is a perspective view showing the completed laminated card.
Figure 9:
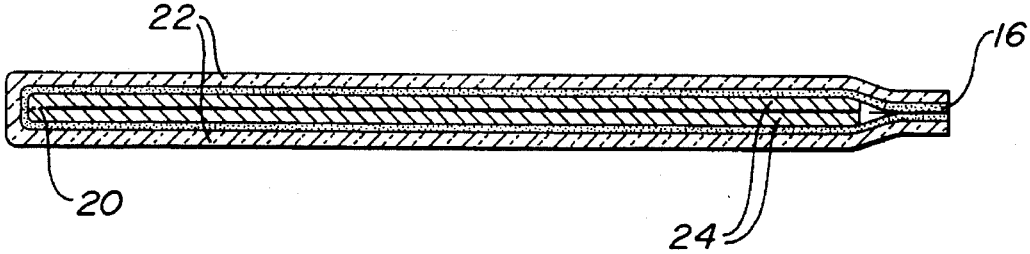
FIG. 9 is a sectional view showing the laminated card of FIG. 8.

The completed laminated card is shown in FIGS. 8 and 9. As shown in FIG. 9, the die cut portion 24 of the liner stock which formed the card is folded and protected by the die cut portion 22 of the transparent film and sealed with adhesive 16. Because the major surfaces of the card are in direct contact with the adhesive, any attempt at tampering will result in damage to the printed indicia on the card. Additionally, the transparent film protects the card and provides resistance to wear, smearing and moisture.

Thus, the present invention provides a construction for the lamination of identification cards, labels, or the like which eliminates the need for separate printing and laminating steps, and which prevents tampering.

While certain representative embodiments and details have been shown for purposes of illustrating the invention, it will be apparent to those skilled in the art that various changes in the methods and apparatus disclosed herein may be made without departing from the scope of the invention, which is defined in the appended claims.

What is claimed is:

1. A construction for producing a laminated card or label carrying printed indicia on both the front and back sides thereof comprising:

a transparent film having a pressure sensitive adhesive on one surface thereof, said film being die cut in the form of a card or label; and liner stock having first and second major surfaces, said first surface including a release coating and being adhered to said pressure sensitive adhesive on said surface of said transparent film, said second surface adapted to receive printed indicia, said liner stock being die cut in the form of a card or label.

2. The construction of claim 1 wherein the front and back sides of said card or label are positioned adjacent each other.

3. The construction of claim 1 wherein said transparent film comprises polyester.

4. The construction of claim 1 wherein said pressure sensitive adhesive comprises a permanent acrylic adhesive.

5. The construction of claim 1 wherein said liner stock comprises a silicone-coated machine finished liner.

6. The construction of claim 1 wherein said front and back sides of said card or label are separated by a score or perforation line.

7. The construction of claim 1 wherein the die cut area of said transparent film extends beyond the die cut area of said liner stock.

8. A construction for producing a laminated card or label comprising:

a transparent film having a pressure sensitive adhesive on one surface thereof, said film being die cut in the form of a card or label; and liner stock having first and second major surfaces, said first surface including a release coating and being adhered to said pressure sensitive adhesive on said surface of said transparent film, said second surface carrying printed indicia, said liner stock being die cut in the form of a card or label which is adapted to be folded such that said printed indicia is facing outward, wherein said card or label is adapted to be laminated with said transparent film such that said printed indicia is in direct contact with said pressure sensitive adhesive on said transparent film, and wherein attempted alteration of said card results in damage to said printed indicia.

9. A construction for producing a laminated card or label carrying printed indicia on both the front and back sides thereof comprising:

a transparent film having a pressure sensitive adhesive on one surface thereof, said film being die cut in the form of a card or label; and liner stock die cut in the form of a card or label and having first and second major surfaces, said first surface including a release coating and being adhered to said pressure sensitive adhesive on said surface of said transparent film, said second surface carrying nonvariable or variable printed indicia within the area bounded by said die cut.

10. A continuous form for producing a series of laminated cards or labels comprising a composite web including a transparent film having a pressure sensitive adhesive on the surface thereof, said film being die cut into a series of cards or labels; and liner stock having first and second major surfaces, said first surface including a release coating and being adhered to said pressure sensitive adhesive on said surface of said transparent film, said second surface adapted to receive printed indicia, said liner stock being die cut into a series of corresponding cards or labels.

11. The continuous form of claim 10 including a series of perforations across said composite ply web forming individual label constructions.

12. A construction for producing a laminated card or label comprising a cut sheet including a transparent film having a pressure sensitive adhesive on one surface thereof, said film being die cut in the form of a card or label; and liner stock having first and second major surfaces, said first surface including a release coating and being adhered to said pressure sensitive adhesive on said surface of said transparent film, said second surface adapted to receive printed indicia, said liner stock being die cut in the form of a card or label.

13. The construction of claim 8 wherein said liner stock includes a score or perforation line along which said liner stock is adapted to be folded.

14. The construction of claim 8 wherein the die cut area of said transparent film extends beyond the die cut area of said liner stock.

15. The construction of claim 9 wherein said liner stock includes a score or perforation line along which said liner stock is adapted to be folded to provide said front and back sides carrying said printed indicia.

16. The construction of claim 9 wherein the die cut area of said transparent film extends beyond the die cut area of said liner stock.

17. The continuous form of claim 10 wherein each of said series of corresponding cards or labels formed from said liner stock includes a score or perforation line along which said card or label is adapted to be folded.

18. The continuous form of claim 10 wherein the die cut areas of individual cards or labels of said transparent film extend beyond the die cut areas of corresponding cards or labels formed from said liner stock.

* * * * *